US010018065B2

(12) United States Patent
Vogel et al.

(10) Patent No.: US 10,018,065 B2
(45) Date of Patent: Jul. 10, 2018

(54) FLOW CONTROL DEVICE FOR ROTATING FLOW SUPPLY SYSTEM

(71) Applicant: ANSALDO ENERGIA IP UK LIMITED, London (GB)

(72) Inventors: Gregory Vogel, Palm Beach Gardens, FL (US); Jeffrey E. Tessier, Jupiter, FL (US); Alain Hernandez, West Palm Beach, FL (US); Chad M. Garner, Jupiter, FL (US)

(73) Assignee: ANSALDO ENERGIA IP UK LIMITED (GB)

( * ) Notice: Subject to any disclaimer, the term of this patent is extended or adjusted under 35 U.S.C. 154(b) by 331 days.

(21) Appl. No.: 14/845,996

(22) Filed: Sep. 4, 2015

(65) Prior Publication Data

US 2017/0067356 A1 Mar. 9, 2017

(51) Int. Cl.

| | |
|---|---|
| ***F01D 5/08*** | (2006.01) |
| ***F01D 11/00*** | (2006.01) |
| ***F01D 5/18*** | (2006.01) |
| ***F01D 5/30*** | (2006.01) |

(52) U.S. Cl.

CPC ..... *F01D 11/006* (2013.01); *F01D 5/18* (2013.01); *F01D 5/187* (2013.01); *F01D 5/3007* (2013.01); *F05D 2220/32* (2013.01); *F05D 2230/60* (2013.01); *F05D 2240/30* (2013.01); *F05D 2260/20* (2013.01)

(58) Field of Classification Search

CPC ..... F01D 11/006; F01D 5/081; F01D 5/3007
See application file for complete search history.

(56) References Cited

U.S. PATENT DOCUMENTS

| | | | | |
|---|---|---|---|---|
| 3,748,060 | A * | 7/1973 | Hugoson | F01D 5/081 416/193 A |
| 4,021,138 | A * | 5/1977 | Scalzo | F01D 5/081 416/95 |
| 4,626,169 | A * | 12/1986 | Hsing | F01D 5/187 416/220 R |
| 5,984,637 | A | 11/1999 | Matsuo | |
| 8,011,894 | B2 * | 9/2011 | Arness | F01D 5/3007 416/219 R |
| 8,770,919 | B2 * | 7/2014 | Hashimoto | F01D 5/087 415/115 |
| 9,759,075 | B2 * | 9/2017 | Bluck | F01D 5/081 |
| 2013/0028743 | A1 * | 1/2013 | Babu | F01D 11/006 416/220 R |
| 2015/0023800 | A1 * | 1/2015 | Bluck | F01D 5/081 416/96 R |

* cited by examiner

*Primary Examiner* — Logan Kraft
*Assistant Examiner* — Jason Fountain
(74) *Attorney, Agent, or Firm* — Hovey Williams LLP

(57) ABSTRACT

This disclosure describes a removable flow control device which may be used in a rotating flow supply system in a gas turbine to optimize coolant flow by improving flow dynamics, reducing leakage of coolant, and reducing pressure loss in the flow supply system. The flow control device may be coupled to a blade and rotor assembly and may include a flow modifier for directing flow through a junction at which cooling channels intersect and are in fluid communication. The device may direct, control, meter, channel, or otherwise modify the flow of coolant, and may be coupled to the blade and rotor assembly independently of other blade components so that coupling and decoupling the flow control device does not require modification or de-stacking of the rotor assembly.

23 Claims, 7 Drawing Sheets

FLOW CONTROL DEVICE FOR ROTATING FLOW SUPPLY SYSTEM

TECHNICAL FIELD

The invention relates to a flow control device for a rotating flow supply system, such as a rotating constant flow supply system used in a rotor and blade assembly in a gas turbine.

BACKGROUND OF THE INVENTION

Gas turbines include numerous components, such as, for example, a combustor for mixing air and fuel for ignition, a turbine blade and rotor assembly for producing power, and a flow supply system for supplying cooling fluid/gas ("coolant") to turbine blade and rotor components when the gas turbine is in operation. Gas turbine combustors often operate at temperatures that can exceed 2,500 degrees Fahrenheit, and as such, the turbine components, including the blade and rotor components, are exposed to these high temperatures. As a result, the flow supply system is useful for cooling the blade and rotor components during operation of the gas turbine to help maintain durability requirements of these components.

Turbine cooling and leakage air ("TCLA") is one form of coolant which may be supplied in a pressurized form through the flow supply system for cooling the blade and rotor components. However, when TCLA, or other coolants, escape from the flow supply system, this negatively impacts the durability of the blade and rotor components, as well as the efficiency and performance of the gas turbine.

In certain blade and rotor assemblies, the flow supply system includes a plurality of junctions at respective rotor blade connections (e.g., a rotor dovetail adjacent a rotor e-block) through which coolant channels are in fluid communication to supply coolant to the associated blade and rotor components. This junction often includes an exposed portion that contributes to the discussed pressure loss, leakage, and sub-optimal flow dynamics of the coolant in the flow supply system, and thus contributes to inefficiency of the gas turbine. However, modifying the rotor and/or the blades to correct this deficiency can be expensive and require complex de-stacking of the rotor blades. Modification also does not allow for continued use of existing, unmodified blade and rotor components. As a result, a new and versatile flow control device that solves these challenges, among others, is needed.

BRIEF SUMMARY

This summary is intended to provide a high-level overview of various aspects of the invention and to introduce a selection of concepts that are further described below in the detailed description section. This summary is not intended to identify key or essential features of the claimed subject matter, nor is it intended to be used as an aid in isolation to determine the scope of the claimed subject matter. The scope of the invention is defined by the claims.

In brief, and at a high level, this disclosure describes, among other things, a flow control device that may be used with a rotating flow supply system in a gas turbine. The flow control device may be coupled to a blade and rotor assembly to modify the flow dynamics of a coolant, such as compressed air, traveling through the rotating flow supply system for cooling the blade and rotor components. The device may direct, control, meter, channel, and/or otherwise modify the flow of the coolant to improve flow dynamics, and additionally may reduce overall pressure loss and leakage of the coolant in the rotating flow supply system. The flow control device may further include a flow modifier (e.g., a curved contour, a chamfer, a flow tab with an opening, etc.) to help control or direct the flow of coolant traveling through the flow supply system.

In a first embodiment of the invention, an assembly for controlling cooling flow in a flow supply system is provided. The assembly comprises a rotor blade and a rotor comprising a rotor blade slot extending axially along an outer surface of the rotor, the rotor blade coupled to the rotor blade slot, a first channel extending radially outward within the rotor, a second channel extending axially along the rotor beneath the rotor blade, and a junction comprising a first side having a first opening in communication with the first channel and a second side having a second opening in communication with the second channel, the junction adjacent an extremity of the rotor blade. The assembly further comprises a flow control device coupled to the extremity of the rotor blade, the flow control device having a flow modifier oriented towards at least one of the first side and the second side of the junction.

In a second embodiment of the invention, a system for controlling cooling flow in gas turbines is provided. The system comprises a rotor, a plurality of rotor blades coupled to the rotor at a plurality of respective rotor blade slots, a plurality of flow control devices, each flow control device coupled to an extremity of one of the plurality of rotor blades, each flow control device and respective rotor blade extremity detachable from each other independently of other flow control devices and their respective rotor blade extremities, and a cooling system comprising a plurality of rotor supply channels and corresponding blade supply channels, each rotor supply channel and corresponding blade supply channel in fluid communication through a junction adjacent one of the rotor blade slots, the junction having an exposed portion. The system further comprises a cooling supply that provides a coolant through each of the plurality of rotor supply channels and corresponding blade supply channels, the coolant passing through each respective junction, wherein each flow control device includes a flow modifier oriented towards a corresponding junction.

In a third embodiment of the invention, a method of adjusting a cooling flow path in a rotating flow supply system is provided. The method comprises providing a blade and rotor assembly comprising a rotor having a rotor blade slot, a rotor blade, a first channel extending radially outward in the rotor to a first opening at a junction adjacent the rotor blade slot, a second channel extending from a second opening at the junction axially along the rotor under the rotor blade when the rotor blade is positioned in the rotor blade slot, wherein the junction includes an exposed portion, and wherein the first and second channels are in fluid communication through the junction. The method further comprises removably coupling a flow control device to an extremity of the rotor blade, wherein the flow control device includes a flow modifier oriented towards at least one of the first opening and the second opening, and wherein the flow control device and the extremity of the rotor blade are de-coupleable independently of other rotor blades and corresponding flow control devices coupled to the rotor.

The flow control device described in this disclosure is discussed frequently in the context of rotating flow supply systems and gas turbine assemblies, but it is not limited only to such systems and assemblies. Rather, the flow control device described in this disclosure is applicable to any flow supply system, including a rotating or non-rotating flow supply system, pressurized or non-pressurized system, or gas, liquid fuel, or mixed fuel system or turbine, among others. Coolant used in the flow supply system, which may be a fluid or a gas, is also described in this disclosure to be non-limiting. The flow control device described herein may be referred to alternatively as a "seal block."

BRIEF DESCRIPTION OF THE DRAWINGS

The present invention is described in detail herein with reference to the attached figures, which are incorporated herein by reference, wherein.

DETAILED DESCRIPTION

The subject matter of various aspects of the present invention is described with specificity herein to meet statutory requirements. However, the description itself is not intended to limit the scope of the invention. Rather, the claimed subject matter might be embodied or carried out in other ways to include different elements, combinations, components, or steps, including those similar to the ones described in this document, in conjunction with other present or future technologies. Furthermore, the term "step" as used in this disclosure shall not indicate any particular order of steps unless such an order is explicitly stated or required.

At a high level, the present invention generally relates to a flow control device that may be used with a blade and rotor assembly in a gas turbine to control, direct, and/or meter coolant traveling through a rotating flow supply system in the blade and rotor assembly. More specifically, the flow control device may be coupled to an extremity (e.g., end portion) of a rotor blade, and/or may include a flow modifier oriented towards a junction in the flow supply system through which coolant supply channels connect, in order to direct, control, meter, and/or modify coolant flow through the junction and improve flow dynamics of the flow supply system. The flow modifier may utilize, for example, a curved contour, chamfer, or a flow tab with an orifice, or some other shape or external feature, to assist in directing, channeling, metering, or modifying the flow of coolant through the flow supply system. The flow control device may be configured to be coupled to and decoupled from the blade and rotor assembly and/or the junction without de-stacking adjacent rotor blades. The flow control device may also act as a seal block, or rather, be configured to fill, seal, or cover at least a portion of an exposed portion of the junction to reduce leakage and associated pressure loss at the junction.

Figure 1:
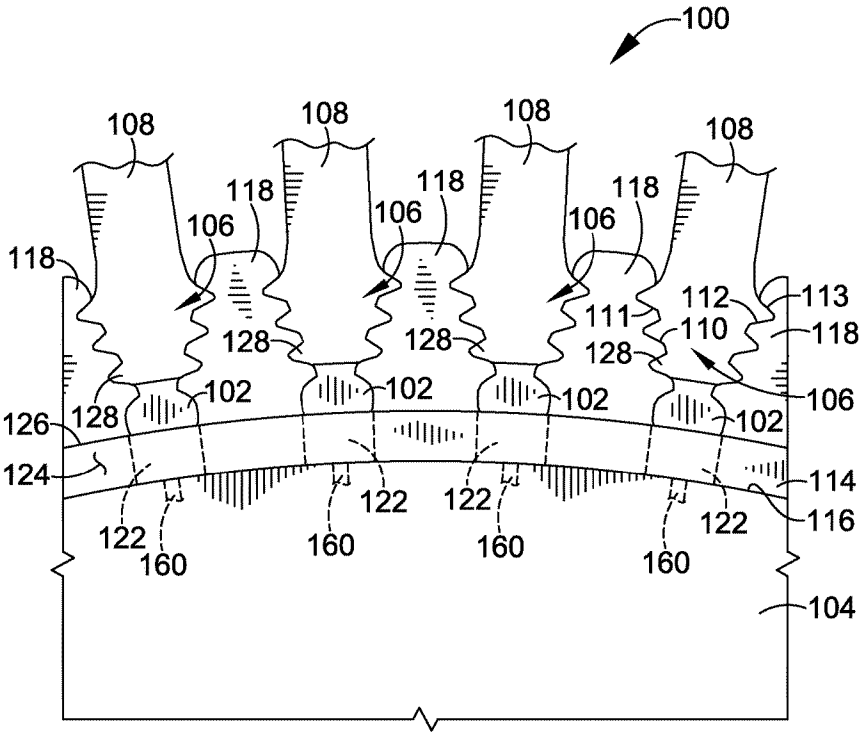
FIG. 1 is a fragmentary elevation view of a portion of a gas turbine blade and rotor assembly that includes multiple flow control devices installed in the assembly, in accordance with an embodiment of the present invention.

Having described some general aspects of the invention, reference is now made to FIG. 1, which depicts a fragmentary elevation view of a portion of a gas turbine blade and rotor assembly 100 that includes multiple flow control devices 102 installed in the assembly 100, in accordance with an embodiment of the present invention. FIG. 1 depicts a rotor 104 having a plurality of rotor blade slots 106 defined at least partially by a plurality of rotor support blocks 118 which are configured to receive and secure a plurality of respective rotor blades 108. Each rotor blade slot 106 includes a first side 110 and a second side 112 that engage with a respective first side 111 and second side 113 of a respective rotor blade 108 positioned in the rotor blade slot 106. Additionally, the rotor 104 may include an e-block 114 that extends circumferentially around an edge 116 of the rotor 104. The e-block 114 may engage with the rotor 104 and/or a rotor support block 118 and be held in place with tapered bolts, or another securing component.

Figure 4:
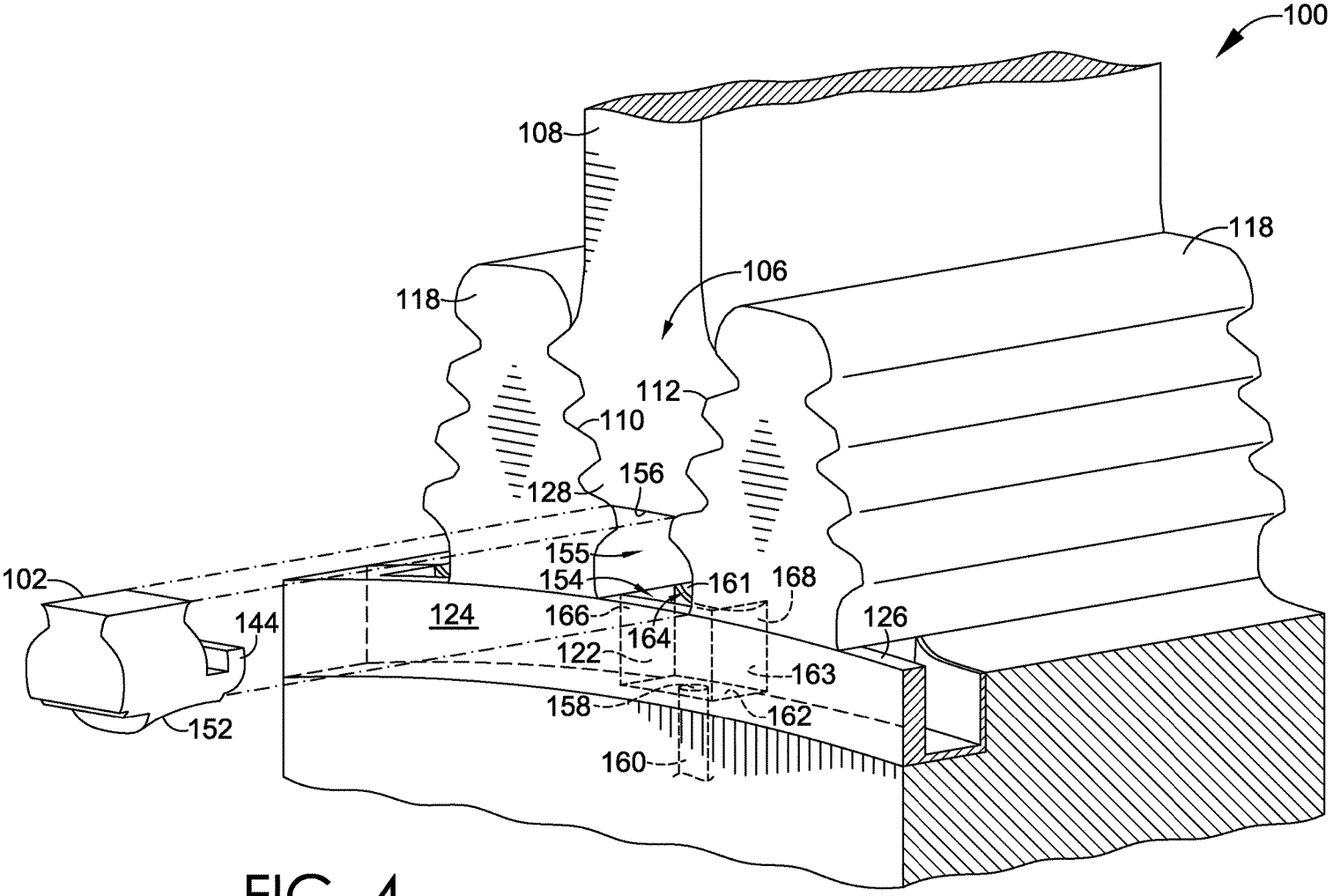
FIG. 4 is a first partial, exploded, angled, perspective view of the blade and rotor assembly depicted in FIG. 1, in accordance with an embodiment of the present invention.

As shown in FIGS. 1 and 4, sections of the e-block 114 include different structural characteristics. For example, sections of the e-block 114 that are beneath the respective rotor support blocks 118 may be solid, and sections of the e-block 114 that are beneath respective rotor blades 108 may include a hollow cavity (shown with dotted lines in FIG. 1), or rather, junctions 122 (the details of each junction 122 in FIG. 1 are obscured by an outer wall 124 of the e-block 114; see FIGS. 4, 6A, and 6B for further detail). The sides 111, 113 of the rotor blades 108 and the sides 110, 112 of the rotor blade slots 106 each include firtree-type, curved contours that allow the rotor support blocks 118 to engage and secure the rotor blades 108, which prevents radial movement of the rotor blades 108 when the assembly 100 is in operation, and spinning.

FIG. 1 further depicts the plurality of flow control devices 102 positioned between the respective rotor blades 108 and the rotor 104. In this respect, the positioning of the flow control devices 102 prevents leakage of coolant that is traveling through the junctions 122 (e.g., between coolant supply channels that connect within the junctions 122) to cool the blades 108 and the rotor 104. Each flow control device 102 depicted in FIG. 1 may be removably coupled to each respective rotor blade 108, rotor 104, junction 122, and/or e-block 114, such that the coupling can be manipulated independently of adjacent rotor blades 108 so that a flow control device 102 can be installed or removed without de-stacking the rotor 104 or the e-block 114. The flow control devices 102 in FIG. 1 may also be coupled to a top edge 126 of the outer wall 124 of the e-block 114 and an extremity 128 of the respective rotor blade 108 in the assembly 100, to help seal the junction 122 and prevent leakage of coolant passing through the junction 122.

Figure 2:
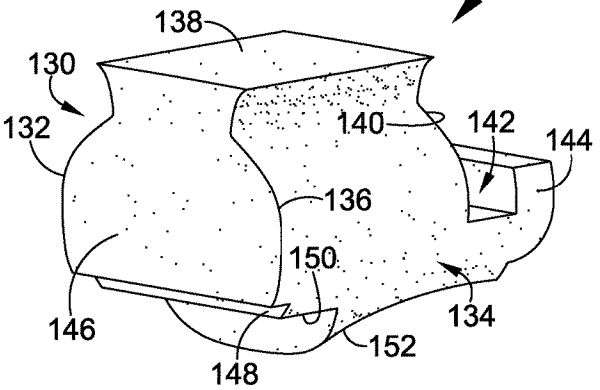
FIG. 2 is a first angled, perspective view of an exemplary flow control device, in accordance with an embodiment of the present invention.
Figure 3:
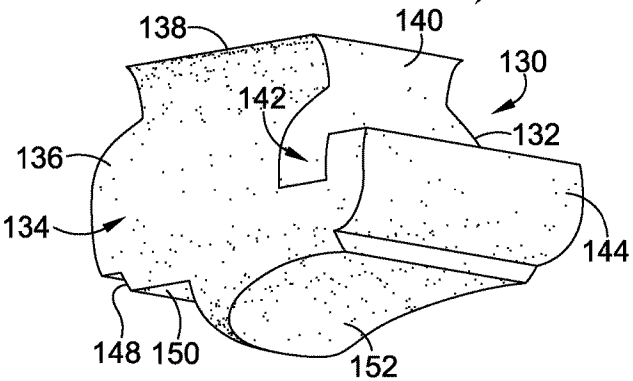
FIG. 3 is a second angled, perspective view of the flow control device depicted in FIG. 2, in accordance with an embodiment of the present invention.

Referring now to FIGS. 2 and 3, first and second angled perspective views of an exemplary flow control device 102 are depicted, respectively, in accordance with an embodiment of the present invention. It should be noted that different shapes or constructions of the flow control device 102 are possible and contemplated, as are different heights and widths, and the flow control device 102 depicted in FIGS. 2 and 3 is merely one exemplary design configured to engage with a correspondingly designed blade and rotor assembly. In FIGS. 2 and 3, the flow control device 102 includes a first side 130 having a first curved contour 132 which may engage with at least a portion of a first side 110 of a rotor blade slot 106, and a second side 134 having a second curved contour 136 which may engage with at least a portion of a second side 112 of a rotor blade slot 106. As shown in relation to FIG. 1, the sides 130, 134 of the flow control device 102 may be designed, shaped, contoured, machined, and/or otherwise formed to mateably engage and/or mateably couple with at least a portion of the respective first and second sides 110, 112 of a respective rotor blade slot 106 so that there is a relatively tight connection between the flow control device 102 and the sides of 110, 112 of the slot 106 to prevent leakage of coolant around the flow control device 102.

The flow control device 102 depicted in FIGS. 2 and 3 further includes a top surface 138 that may be configured to mateably engage with a portion of a bottom surface 156 of a rotor blade 108, or even engage with a short indented portion of the bottom surface 156 of the rotor blade 108. Additionally, the flow control device 102 depicted in FIGS. 2 and 3 includes a front surface 140 with a coupling 142 having a hook portion 144. The hook portion 144 may be configured to engage and secure a rotor blade tab 170 or other portion of a rotor blade 108 (e.g., a portion of the rotor blade at a rotor dovetail adjacent an e-block) to help secure the flow control device 102 to the rotor blade 108. The flow control device 102 further includes an outer flat wall 146 with a strip portion 148 that can be configured to fill at least part of an exposed portion 155 between an extremity 128 of the corresponding rotor blade 108 and a top edge 126 of an outer wall 124 of the e-block 114 (or of a rotor 104 in a situation where the outer wall 124 and the e-block 114 are one integral part of the rotor 104), as discussed further below in relation to FIGS. 6A and 6B.

As shown in FIGS. 2 and 3, a bottom surface 150 of the flow control device 102, which is generally opposite the top surface 138 of the flow control device 102, includes a flow modifier 152 (which in the embodiment shown in FIGS. 2 and 3 incorporates a curved contour), which may be at least partially positioned in or oriented towards a junction 122 of a rotor blade 108 to help control a flow path for coolant traveling through the corresponding junction 122 when the flow control device 102 is coupled to the rotor blade 108. The flow modifier 152 may include one or multiple shapes, grooves, curves, and/or flow paths that direct a flow of coolant through the junction 122 to optimize flow dynamics.

Referring now to FIG. 4, a first partial, exploded, angled, perspective view of the blade and rotor assembly 100 of FIG. 1 is depicted, in accordance with an embodiment of the present invention. FIG. 4 depicts the rotor 104, the e-block 114, and an exemplary rotor blade 108 coupled to two adjacent rotor support blocks 118 (for clarity, this is presented in isolation; this may be repeated around the circumference of the rotor 104). Additionally, the junction 122 in the e-block wall 114 includes an opening 154 oriented towards the bottom surface 156 of the rotor blade 108. Furthermore, between a top edge 126 of the outer wall 124 of the e-block 114 and the extremity 128 of the rotor blade 108 is an exposed portion 155 through which coolant may escape the junction 122.

Figure 6B:
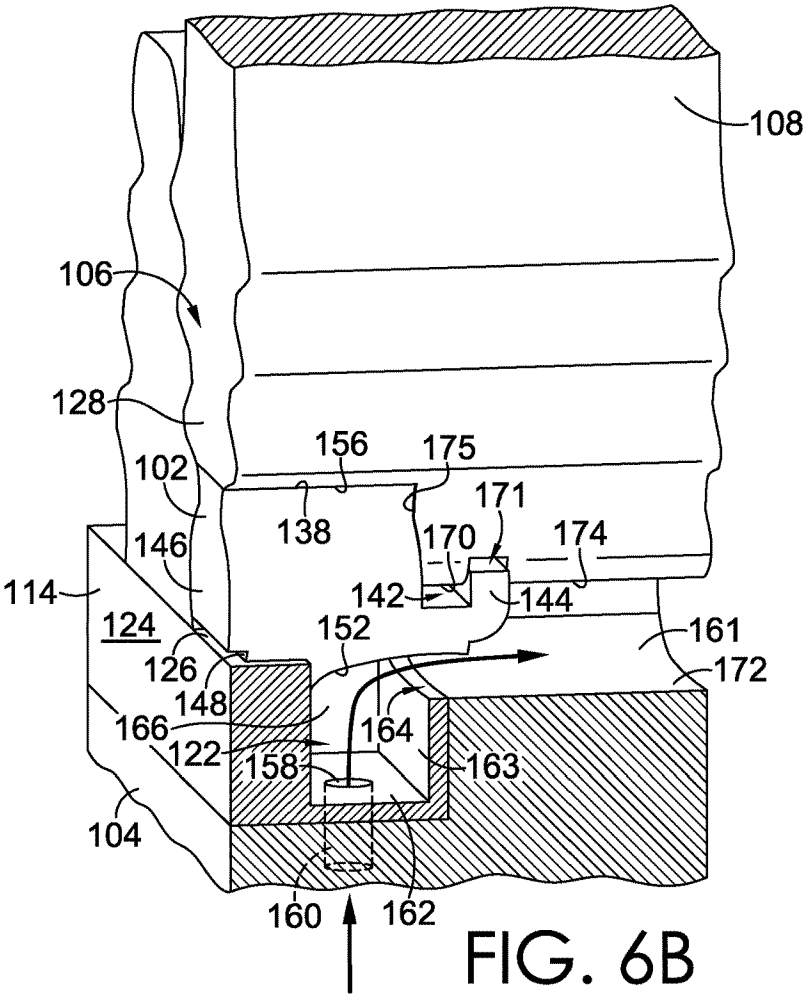
FIG. 6B is a partial, cross-sectional, angled, perspective view of the blade and rotor assembly depicted in FIG. 6A after installation of the flow control device, in accordance with an embodiment of the present invention.
Figure 6A:
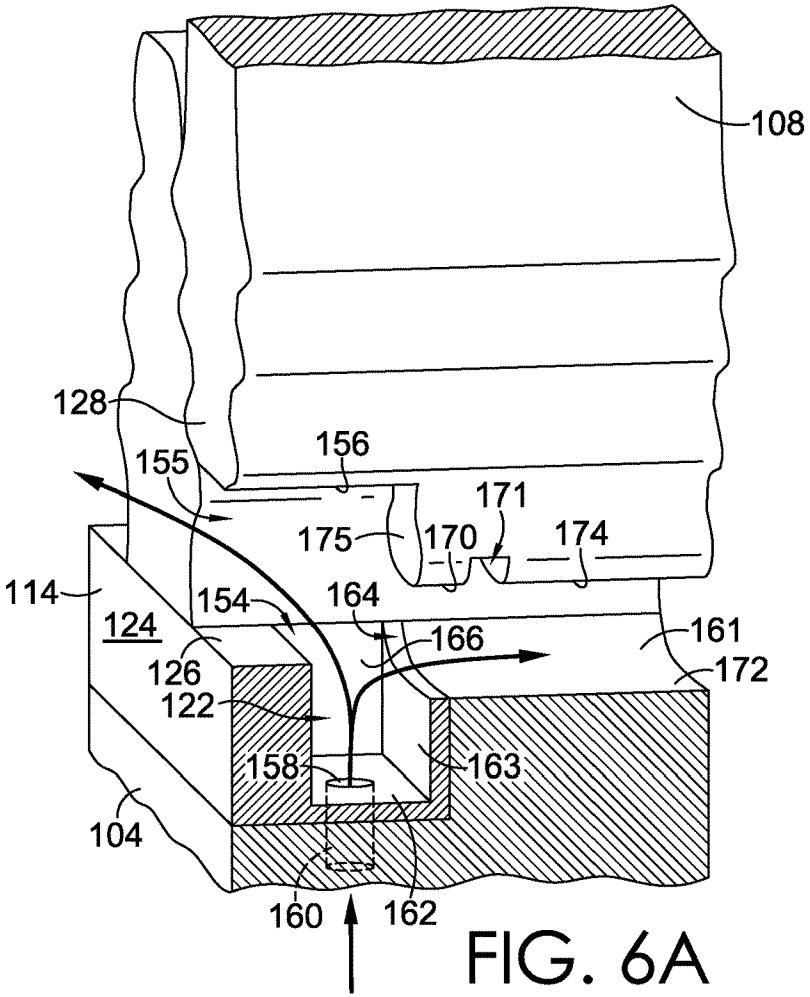
FIG. 6A is a partial, cross-sectional, angled, perspective view of the rotor assembly of FIG. 1 prior to installation of a flow control device, in accordance with an embodiment of the present invention.

The junction 122 includes a first opening 158 that is an outlet for coolant supplied through a rotor supply channel 160 that extends radially through the rotor 104 from a center portion of the rotor 104, the first opening 158 located on a first side 162 of the junction 122. The junction 122 further includes a second opening 164 on a second side 163 of the junction 122 that is an inlet for a blade supply channel 161 (e.g., a broach slot) that carries coolant beneath the rotor blade 108. In this respect, the rotor supply channel 160 and the blade supply channel 161 may be in fluid communication through the junction 122. The coolant exits the rotor supply channel 160 at the first opening 158, and at least a portion of the coolant that is ejected into the junction 122, and which does not escape the junction 122 through the opening 154 and the exposed portion 155, travels into the blade supply channel 161. As shown in FIGS. 6A & 6B, the opening 154 and the exposed portion 155 of the junction 122 may allow coolant (e.g., TCLA) to escape from the junction 122 when the flow control device 102 is not in position and coupled to the extremity 128 of the rotor blade 108, at least partially sealing the opening 154 and the exposed portion 155 of the junction 122.

Furthermore, FIG. 6B depicts how the flow modifier 152 of the flow control device 102 may be positioned in and/or oriented towards the junction 122 to at least partially direct or channel a flow of coolant from the rotor supply channel 160 to the blade supply channel 161 through the junction 122. Stated differently, when the flow control device 102 is in place, and as coolant travels from the first opening 158 to the second opening 164 within the junction 122, the coolant is able to follow a more linear, unidirectional path through the junction 122. The flow modifier 152 may be at least partially positioned between a first side wall 166 and a second side wall 168 of the junction 122 within the e-block 114, and may be oriented towards at least one of the first opening 158 and the second opening 164, and/or rather, towards at least one of the first and the second sides 162, 163. The shape, features, and/or curvature of the flow modifier 152 shown in FIG. 6B may be adjusted or varied to provide the most optimized flow dynamics through the junction 122, and also to minimize or reduce pressure loss and leakage of coolant in the junction 122.

Figure 5:
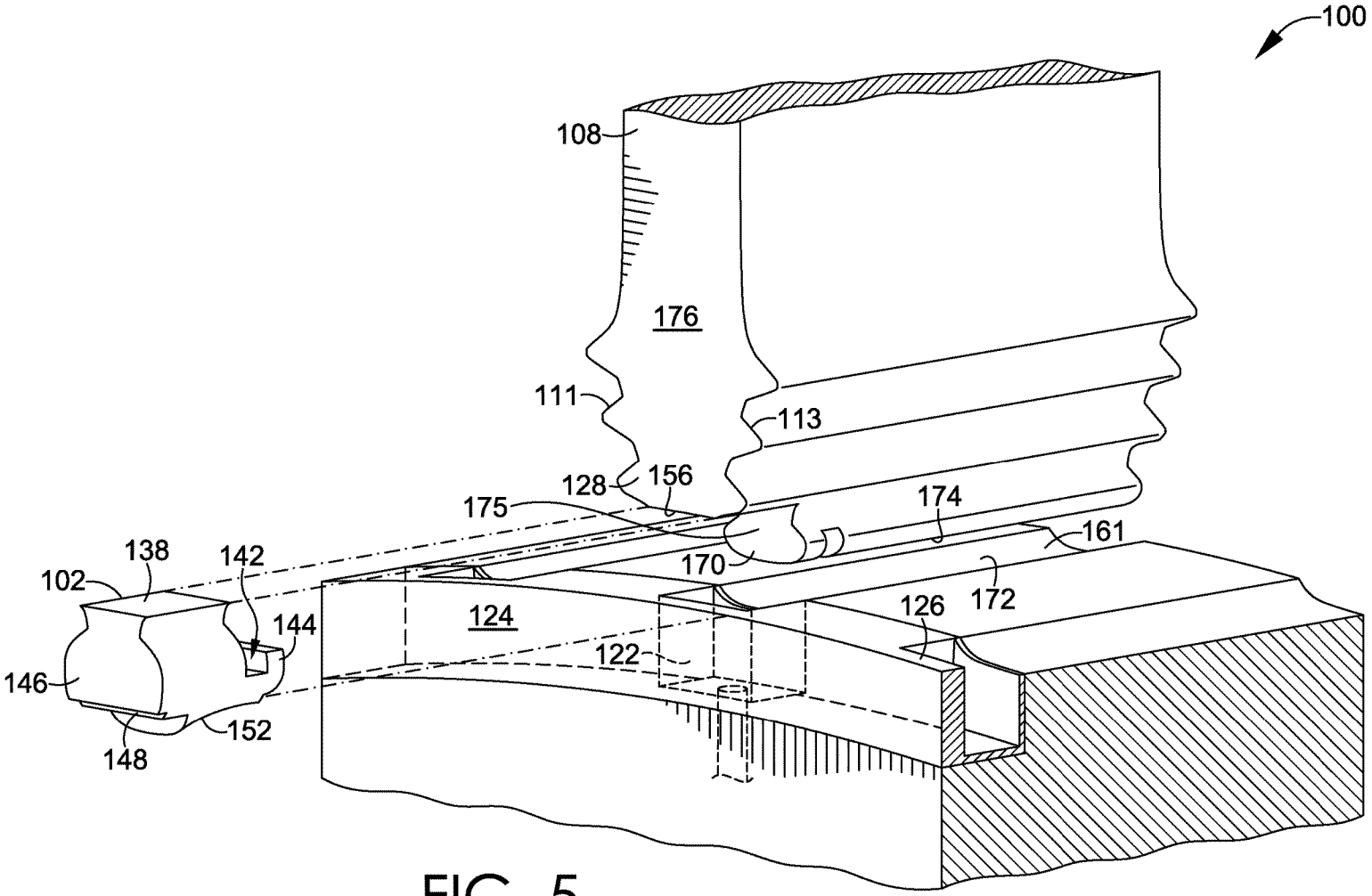
FIG. 5 is a second partial, exploded, angled, perspective view of the blade and rotor assembly depicted in FIG. 1, in accordance with an embodiment of the present invention.

Referring now to FIG. 5, a second partial, exploded, angled, perspective view of the blade and rotor assembly 100 shown in FIG. 1, with adjacent rotor blades 108 and adjacent rotor support blocks 118 removed for clarity, is depicted, in accordance with an embodiment of the present invention. In FIG. 5, the rotor blade 108 is shown with a first mateable engaging side 111, a second mateable engaging side 113, and a rotor blade tab 170. The flow control device 102 depicted in FIG. 5 includes the coupling 142 and the hook portion 144, with the hook portion 144 configured to engage and secure the rotor blade tab 170 to couple the flow control device 102 to the extremity 128 of the rotor blade 108. Furthermore, the outer flat wall 146 of the flow control device 102 may, in embodiments, at least partially align with the outer wall 124 of the e-block 114 and/or of the rotor 104, and/or may align with a face 176 of the rotor blade 108, helping the flow control device 102 fill or cover the exposed portion 155 of the junction 122. Additionally, the flow control device 102 may be coupled to a front surface 175 of the rotor blade tab 170 when the hook portion 144 of the flow control device 102 is coupled to the rotor blade tab 170.

In the exemplary embodiment shown in FIG. 5, the rotor supply channel 160 is oriented axially along an outside surface of the rotor 104, and more specifically, is at least partially defined by a bottom channel 172 running along an outer surface of the rotor 104 and a bottom side 174 of the corresponding rotor blade 108. The blade supply channel 161 may take any number of shapes, including a circular, ovular, trapezoidal, or elliptical shape, among other shapes, and may not be defined by a part of the rotor blade 108 as shown in FIG. 5, but may be internal to the rotor 104 or simply separate from the rotor blade 108. The strip portion 148 may be in contact with the top edge 126 of the outer wall 124 to help seal the exposed portion 155 and prevent leakage of coolant around the flow control device 102 (this can be further facilitated by applying an abradable coating to the flow control device 102, junction 122, and/or rotor blade 108).

Referring now to FIG. 6A, a partial, cross-sectional, angled, perspective view of the assembly 100 of FIG. 1 prior to installation of a flow control device 102 is provided, in accordance with an embodiment of the present invention. In FIG. 6A, the e-block 114 is shown more clearly, within which the junction 122 is at least partially defined by the first side 162 having the first opening 158 that is an outlet for coolant from the rotor supply channel 160, and the second side 163 having a second opening 164 that is an inlet for the coolant that has exited the rotor supply channel 160 and entered the junction 122, allowing the coolant to travel down the rotor supply channel 161 beneath the rotor blade 108. The opening 154 of the junction 122 may allow at least a portion of the coolant to escape from the junction 122 out of the exposed portion 155 when the flow control device 102 is not in place in the assembly 100. Additionally, when the coolant enters the unsealed junction 122 from the rotor supply channel 160, the sudden expansion of the coolant causes a pressure loss that reduces efficiency of the flow supply system. Thus, providing a flow control device 102 that seals the exposed portion 155 of the junction 122, and that includes the flow modifier 152 that directs the flow of coolant traveling within the junction 122, may improve flow dynamics and pressure loss.

Referring now to FIG. 6B, a partial, cross-sectional, angled, perspective view of the blade and rotor assembly depicted in FIG. 6A after installation of a flow control device is provided, in accordance with an embodiment of the present invention. In FIG. 6B, the flow control device 102 is positioned at least partially between the extremity 128 of the rotor blade 108 and the junction 122. The strip portion 148 is in contact with the top edge 126 of the outer wall 124 to help seal the exposed portion 155. The top surface 138 of the flow control device 102 is coupled to the bottom surface 156 of the rotor blade 108. Further, the rotor blade tab 170, or rather, a hook slot 171 associated with the rotor blade tab 170, of the rotor blade 108 is engaged with the hook portion 144 on the flow control device 102. FIG. 6B demonstrates how the installed flow control device 102 and the sealing of the junction 122 with the strip portion 148 prevents leakage of coolant through the opening 154 and the exposed portion 155 of the junction 122 shown in FIG. 6A.

Additionally, as shown in FIG. 6B, the flow modifier 152 of the flow control device 102, which in FIG. 6B is positioned substantially in the junction 122, helps to direct, or channel, the flow of coolant exiting from the rotor supply channel 160 towards the blade supply channel 161 to provide a more streamlined, laminar, and non-turbulent transition between the rotor supply channel 160 and the blade supply channel 161. The flow modifier 152 is oriented towards the junction 122, and extends at least partially between side walls 166, 168 of the junction 122 (side wall 168 is not visible due to the cut-away; see FIG. 4), and faces towards at least one of the first and the second openings 158, 164, or rather, towards at least one of the first and the second sides 162, 163, of the junction 122. The flow control device 102, and more specifically, the flow modifier 152, also helps to meter the flow of coolant entering the blade supply channel 161 through the second opening 164 by controlling a cross-sectional area of the second opening 164, thereby controlling the entry of coolant into the second opening 164 and down the blade supply channel 161.

As shown in FIG. 6B, the flow control device 102 provides a barrier between the junction 122 and the outside of the assembly 100, providing a more sealed pathway for coolant within the flow supply system. Additionally, as shown in FIG. 6B, the flow control device 102 is coupled to the rotor blade 108 independently of other rotor blades 108. In other words, the flow control device 102, although selectively coupled to one extremity 128 of the rotor blade 108, may not be secured or interlinked to other rotor blades 108, or components of the assembly 100 attached to other rotor blades 108, such that removing or installing the flow control device 102 in FIG. 6B requires decoupling of other parts of the assembly 100 or de-stacking of rotor blades 108 adjacent to the flow control device 102 shown in FIG. 6B. In this respect, a single rotor blade 108 may be modified to attach or detach a flow control device 102 as needed, without de-stacking of multiple rotor blades 108.

Furthermore, a level of coolant flow to the rotor blade channel 161 may be adjusted by varying the minimum cross-sectional area at the exit of the flow modifier 152 of each flow control device 102, or rather, adjusting the cross-sectional area where the coolant passes into the blade supply channel 161. This may be achieved by selecting a specific thickness of the flow control device 102 or a specific angle or design of the flow modifier 152, or by controlling an orifice or opening attached to the flow control device 102. As a result, an optimized aerodynamic configuration is provided for the coolant flow turn, and turbulence of coolant entering the blade supply channel 161 may be reduced or limited with the flow control device 102.

Figure 7:
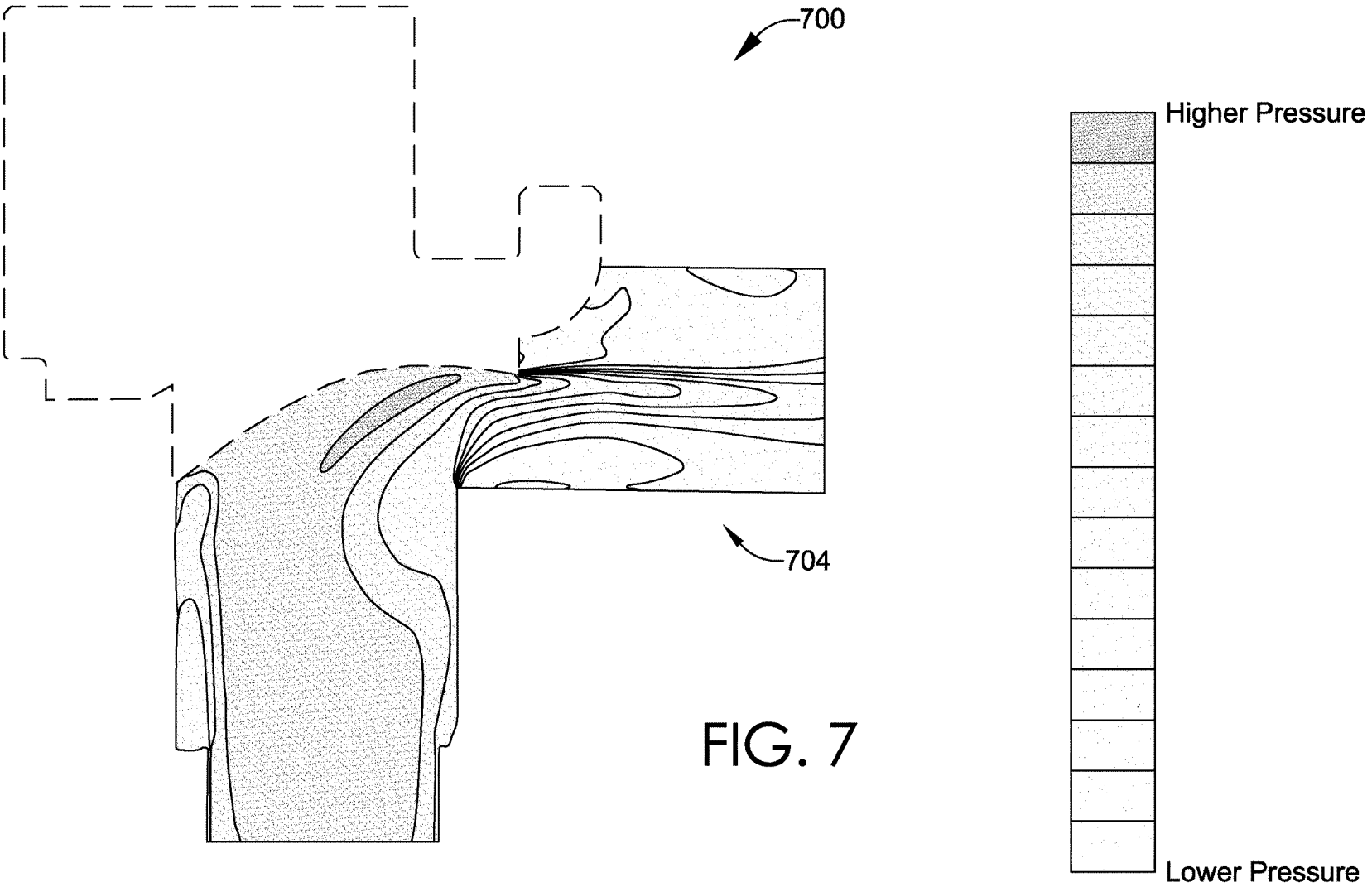
FIG. 7 is a relative total pressure distribution diagram associated with an exemplary flow supply system incorporating a flow control device, in accordance with an embodiment of the present invention.

Referring now to FIG. 7, a relative total pressure distribution diagram associated with an exemplary flow supply system incorporating a flow control device is provided, in accordance with an embodiment of the present invention. On the right side of FIG. 7 is a dimensionless scale for the relative total pressure chart 702. On the left of FIG. 7 is an exemplary pressure diagram 704 for a junction, such as the junction 122 in FIG. 4, in a flow supply system used in a blade and rotor assembly, such as the assembly 100 that includes the flow control device 102. As shown by the pressure indications in FIG. 7, a flow control device, which may be the flow control device 102 with the flow modifier 152 shown in FIGS. 2-3, helps to direct the flow of coolant from a first direction in the junction to a second direction in the junction, or possibly rather, from a first coolant supply channel to a second coolant supply channel, which may be the rotor supply channel 160 and the blade supply channel 161 shown in FIGS. 6A and 6B, respectively. The flow control device, and in particular, the flow modifier, helps to smooth out the flow and provide a less turbulent transition between the first channel and the second channel, as depicted in FIG. 7.

Figure 8:
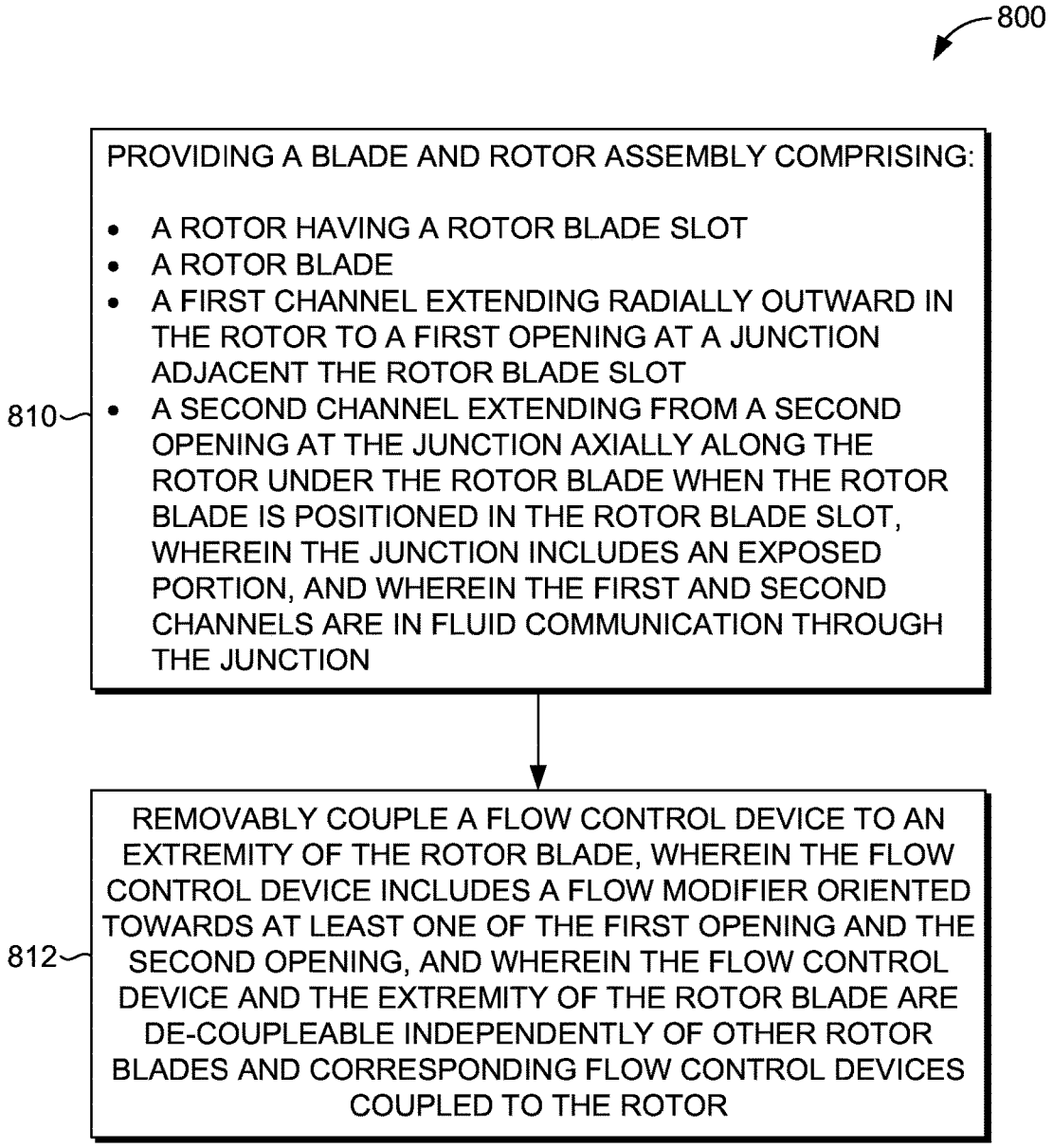
FIG. 8 is a block diagram of an exemplary method for controlling cooling flow in a rotating flow supply system, in accordance with an embodiment of the present invention.

Referring now to FIG. 8, a block diagram of a method 800 of adjusting a cooling flow path in a rotating flow supply system is provided, in accordance with an embodiment of the present invention. At a block 810, a blade and rotor assembly, such as the rotor assembly 100 shown in FIG. 1, is provided. The assembly comprises a rotor, such as the rotor 104 shown in FIG. 1, having a rotor blade slot, such as the slot 106 shown in FIG. 1, a rotor blade, such as the rotor blade 108 shown in FIG. 1, a first channel, such as the rotor supply channel 160 shown in FIGS. 6A and 6B, extending radially outward in the rotor to a first opening, such as the first opening 158 shown in FIGS. 6A and 6B, at a junction, such as the junction 122 shown in FIGS. 6A and 6B, adjacent the rotor blade slot. The assembly further comprises a second channel, such as the blade supply channel 161 shown in FIGS. 6A and 6B, extending from a second opening, such as the second opening 164 shown in FIGS. 6A and 6B, at the junction axially along the rotor under the rotor blade when the rotor blade is positioned in the rotor blade slot, where the junction includes an exposed portion, such as the exposed portion 155 shown in FIG. 6A, and where the first and second channels are in fluid communication through the junction. At a second step 812, a flow control device, such as the flow control device 102 shown in FIGS. 2 and 3, is removably coupled to an extremity of the rotor blade, such as the extremity 128 shown in FIGS. 6A and 6B, where the flow control device includes a flow modifier, such as the flow modifier 152 shown in FIGS. 2 and 3, oriented towards at least one of the first opening and the second opening, and where the flow control device and the extremity of the rotor blade are de-coupleable independently of other rotor blades and respective flow control devices coupled to the rotor.

Figure 9:
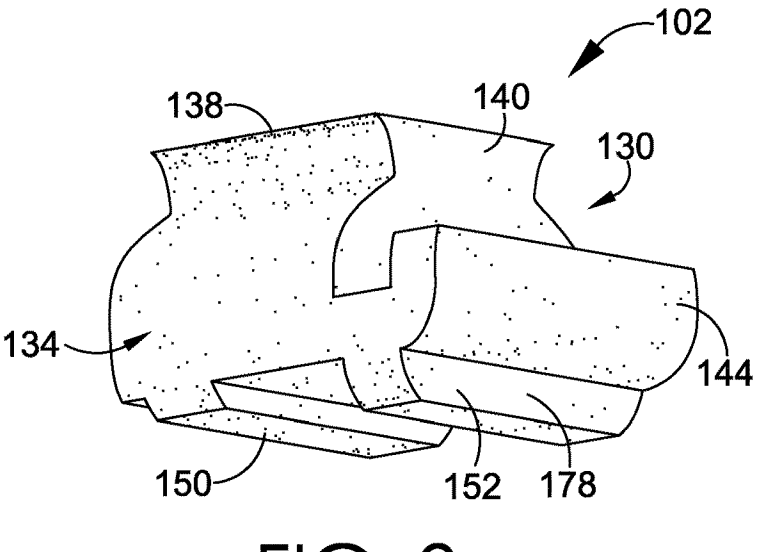
FIG. 9 is an angled, perspective view of a first alternate flow control device, in accordance with an embodiment of the present invention.

FIG. 9 is an angled, perspective view of a first alternate flow control device 102, in accordance with an embodiment of the present invention. In FIG. 9, the flow control device 102 includes a flow modifier 152, which in the embodiment shown in FIG. 9 is in the form of a chamfer 178 on the bottom 150, that may provide a directional bias for a flow of coolant passing along the bottom 150 of the flow control device 102 when the flow control device 102 is positioned in a junction, such as the junction 122 shown in FIGS. 6A and 6B.

Figure 10:
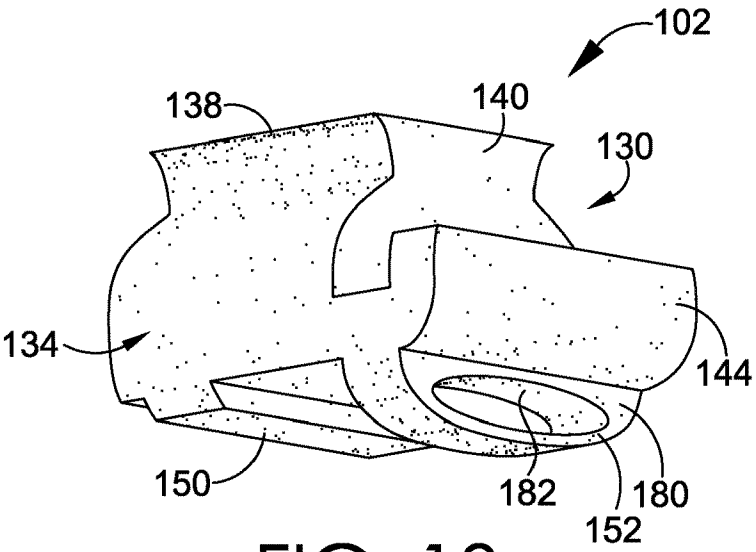
FIG. 10 is an angled, perspective view of a second alternate flow control device, in accordance with an embodiment of the present invention.

FIG. 10 is an angled, perspective view of a second alternate flow control device 102, in accordance with an embodiment of the present invention. In FIG. 10, the flow control device 102 includes a flow modifier 152, which in the embodiment shown in FIG. 10 is in the form of a flow tab 180 on the bottom 150, that may help to channel, or direct, a flow of coolant passing along the bottom 150 of the flow control device 102. The flow tab 180 includes an opening 182 that may meter, direct, and/or otherwise control the flow of coolant traveling along the bottom 150 of the flow control device 102 and through the opening 182, depending on the shape, size, and orientation of the opening 182 in the flow tab 180.

An exemplary flow control device, or seal block, for improving flow dynamics, pressure loss, and leakage of coolant, among other issues, in a rotating flow supply system may include a first end having a flat portion and a coupling portion. The coupling portion may include a hook for engaging a bucket tab on an extremity of a rotor blade, or another portion of the extremity of a rotor blade. The flow control device may include a second end that is substantially flat, and that may be parallel to at least a portion of the first end. The flow control device may further include a first side that is configured to mateably engage with at least a portion of a side of a first blade support block, and a second side configured to mateably engage with at least a portion of a side of a second blade support block. The flow control device may include a top surface that is at least partially flat, and that is configured to at least partially engage with a bottom surface of an extremity of a rotor blade. The flow control device may further include a bottom surface with a flow modifier. The flow modifier may form, utilize, and/or include a curved contour, a chamfer, and/or a flow tab with an orifice, among other configurations, to help direct a flow of coolant. Additionally, any of these structures may also compliment a strip portion on the bottom of the flow control device which may be configured to help seal an exposed portion of a corresponding junction in which the flow control device is positioned.

The flow control device may further be described as a removable flow metering block, or seal block, that may be positioned at an exit of a flow supply system, or a constant flow supply system, and may be designed to fit into a rotor dovetail adjacent a rotor e-block, such as the e-block 114 described in this disclosure. The flow control device may engage a rotor dovetail by being installed through a rotor blade slot, during which the flow control device is held in place with a blade hook slot on the rotor blade. The flow control device may reduce the flow delivering capacity of the constant flow supply system, acting as an external component to the system, to provide a decrease in pressure loss and overall leakage flow around the flow control device. The possible retro-fitted nature of the flow control device, due to its ability to be custom designed and fitted at an exit of a flow supply system, means that modification to an existing blade and rotor assembly may not be required at an installation site. In this respect, modification of other parts of the assembly that would require removing, re-machining, or replacing those parts may also not be required.

For each rotor blade positioned radially around the rotor, the corresponding flow control device may be coupled to the rotor independently of other flow control devices and their respective rotor blades. More specifically, each flow control device may be independently coupled to the extremity of a corresponding rotor blade and also may be de-coupled from the extremity of the corresponding rotor blade without de-stacking, dislodging, or removing adjacent or additional rotor blades around the rotor, or removing pieces that connect adjacent rotor blades, junctions, or flow control devices. In other words, the flow control device may not be selectively secured to more than one rotor blade. By having this segmented, separated attachment construction, modification of the blade and rotor assembly is possible without the additional work of moving or de-coupling rotor blades or pieces that interlink multiple rotor blades, or disassembling the e-block. This also allows different or independently designed flow control devices to be used with multiple rows of turbine blades at the same time with different levels of individual performance for the different rows of turbine blades, in order to provide maximum versatility for blade and rotor cooling.

The flow control device allows improved sealing capability of flow leaking through the exposed portion, which may be across from the blade supply channel (which in turbine blade and rotor assemblies is often referred to as a "broach slot"). The curved shape or contour on the bottom side of the flow control device helps to prevent air from flowing in an opposite direction as intended, or rather, away from the blade supply channel. The flow control device may provide a greater cross-sectional area of sealing surface around the exposed portion and junction.

The flow control device and/or rotor blade slot may further include an abradable coating that may help to provide a sealed connection around the flow control device. The abradable coating may be applied to portions of the flow control device which are in contact with other portions of the blade and rotor assembly, such as the bottom surface 150 and the strip portion 148 of the flow control device 102 shown in FIGS. 2 and 3 that may provide a sealing barrier between the flow control device 102 and the top edge 126 of the outer wall 124. The abradable coating may also be applied to sides of the flow control device, such as the sides 130, 134 of the flow control device 102 shown in FIGS. 2 and 3, and/or a coupling or hook portion of the flow control device, such as the coupling 142 and/or the hook portion 144 of the flow control device 102 shown in FIGS. 2 and 3. Additional surfaces on or around the flow control device (e.g., on an extremity of the rotor blade) may have applied an abradable coating as needed to help seal the flow control device in the corresponding junction and help prevent pressure loss.

Embodiments of the invention have been described in this disclosure to be illustrative rather than restrictive, and alternative embodiments will become apparent to readers of this disclosure after and because of reading it. Furthermore, alternative means of implementing the aforementioned elements and steps can be used without departing from the scope of the claims below, as would be understood by one having ordinary skill in the art. Certain features and sub-combinations are of utility and may be employed without reference to other features and sub-combinations, and are contemplated as within the scope of the claims.

What is claimed is:

1. An assembly for controlling cooling flow in a flow supply system, the assembly comprising:
- a rotor blade; and
- a rotor comprising:
  - a rotor blade slot extending axially along an outer surface of the rotor, the rotor blade coupled to the rotor blade slot;
  - a first channel extending radially outward within the rotor;
  - a second channel extending axially along the rotor beneath the rotor blade;
  - a junction comprising a first side having a first opening in communication with the first channel, a second side having a second opening in communication with the second channel, and an outer wall that extends from the first side of the junction towards the rotor blade, the junction adjacent an extremity of the rotor blade; and
  - a flow control device coupled to the extremity of the rotor blade, the flow control device having a flow modifier oriented towards at least one of the first side and the second side of the junction, wherein the flow control device is in contact with a top edge of the outer wall.

2. The assembly of claim 1, wherein the flow control device is removably coupled to the extremity of the rotor blade.

3. The assembly of claim 2, wherein the flow modifier comprises a curved contour on the flow control device.

4. The assembly of claim 3, further comprising a cooling system that supplies pressurized air through the first channel, the second channel, and the junction.

5. The assembly of claim 4, wherein the flow control device is positioned at least partially between the extremity of the rotor blade and the junction.

6. The assembly of claim 3, wherein the curved contour directs coolant exiting the first channel at the first opening from a first direction to a second direction, wherein the second direction is oriented towards the second opening.

7. The assembly of claim 3, wherein the rotor blade slot includes a first side and a second side, and wherein the flow control device further comprises:
- a first side that engages with the first side of the rotor blade slot;
- a second side that engages with the second side of the rotor blade slot; and
- a top surface that engages with a bottom surface of the rotor blade.

8. The assembly of claim 7, wherein the flow control device is coupled to the extremity such that the flow control device and the rotor blade can be decoupled without de-stacking multiple rotor blades coupled to the rotor at respective rotor blade slots.

9. The assembly of claim 7, wherein the flow control device, when coupled to the extremity of the rotor blade, at least partially defines a cross-sectional area between the first side and the second side of the junction that controls the flow.

10. The assembly of claim 7, wherein the junction further comprises a first side wall and a second side wall, and wherein the curved contour of the flow control device is positioned at least partially between the first side wall and the second side wall of the junction.

11. The assembly of claim 3, wherein the flow control device at least partially seals an exposed portion of the junction, reducing at least one of leakage and pressure loss of coolant passing through the junction.

12. A system for controlling cooling flow in gas turbines, the system comprising:
- a rotor;
  - a plurality of rotor blades coupled to the rotor at a plurality of respective rotor blade slots;
  - a plurality of flow control devices, each flow control device coupled to an extremity of one of the plurality of rotor blades, each flow control device and respective rotor blade extremity detachable from each other independently of other flow control devices and their respective rotor blade extremities; and
- a cooling system comprising:
  - a plurality of rotor supply channels and corresponding blade supply channels, each rotor supply channel and corresponding blade supply channel in fluid communication through a junction adjacent one of the rotor blade slots, the junction having an exposed portion; and
  - a cooling supply that provides a coolant through each of the plurality of rotor supply channels and corresponding blade supply channels, the coolant passing through each respective junction,
  - wherein each flow control device includes a flow modifier oriented towards a corresponding junction,
  - wherein the coolant is provided from a center portion of the rotor,
  - wherein each rotor supply channel extends radially from the center portion of the rotor to an e-block at an edge of the rotor,
  - wherein each junction is located in the e-block, and
  - wherein each blade supply channel extends from a respective junction axially along the rotor beneath a corresponding rotor blade.

13. The system of claim 12, wherein the flow modifier comprises a curved contour on the flow control device.

14. The system of claim 13, wherein each junction includes a first side having a first opening in communication with a rotor supply channel and a second side having a second opening in communication with a blade supply channel.

15. The system of claim 14, wherein each junction includes an outer wall that comprises the e-block and that extends from the first side of the junction at least part of the way to a corresponding rotor blade, such that there is an exposed portion between the outer wall and the corresponding rotor blade.

16. The system of claim 13, wherein a front surface of each flow control device is coupled to a front surface of a rotor blade tab of a corresponding rotor blade.

17. The system of claim 13, wherein the curved contour of each flow control device directs a coolant exiting a corresponding rotor supply channel from a first direction to a second direction, wherein the second direction is oriented towards a corresponding blade supply channel.

18. A system for controlling cooling flow in gas turbines, the system comprising:

a rotor;

a plurality of rotor blades coupled to the rotor at a plurality of respective rotor blade slots;

a plurality of flow control devices, each flow control device coupled to an extremity of one of the plurality of rotor blades, each flow control device and respective rotor blade extremity detachable from each other independently of other flow control devices and their respective rotor blade extremities; and a cooling system comprising:

a plurality of rotor supply channels and corresponding blade supply channels, each rotor supply channel and corresponding blade supply channel in fluid communication through a junction adjacent one of the rotor blade slots, the junction having an exposed portion and including an outer wall that comprises an e-block and that extends from the first side of the junction at least part of the way to a corresponding rotor blade, such that there is an exposed portion between the outer wall and the corresponding rotor blade; and a cooling supply that provides a coolant through each of the plurality of rotor supply channels and corresponding blade supply channels, the coolant passing through each respective junction, wherein each flow control device includes a flow modifier oriented towards a corresponding junction.

19. The system of claim 18, wherein the flow modifier comprises a curved contour on the flow control device.

20. The system of claim 19, wherein the coolant is provided from a center portion of the rotor, wherein each rotor supply channel extends radially from the center portion of the rotor to the e-block at an edge of the rotor, wherein each junction is located in the e-block, and wherein each blade supply channel extends from a respective junction axially along the rotor beneath a corresponding rotor blade.

21. The system of claim 19, wherein each junction includes a first side having a first opening in communication with a rotor supply channel and a second side having a second opening in communication with a blade supply channel.

22. The system of claim 19, wherein a front surface of each flow control device is coupled to a front surface of a rotor blade tab of a corresponding rotor blade.

23. The system of claim 19, wherein the curved contour of each flow control device directs a coolant exiting a corresponding rotor supply channel from a first direction to a second direction, wherein the second direction is oriented towards a corresponding blade supply channel.

* * * * *